US005325762A

United States Patent [19]

Walsh et al.

[11] Patent Number: 5,325,762

[45] Date of Patent: Jul. 5, 1994

[54] FLUID PRESSURE OPERATED PISTON ENGINE ASSEMBLY

[75] Inventors: John T. Walsh, Duluth; Robert J. Woodlief, Lawrenceville; Patricia A. Sloan, Canton, all of Ga.

[73] Assignee: Nordson Corporation, Westlake, Ohio

[21] Appl. No.: 96,862

[22] Filed: Jul. 26, 1993

Related U.S. Application Data

[63] Continuation of Ser. No. 968,447, Oct. 29, 1992, abandoned.

[51] Int. Cl.[5] ..... F01L 25/08; F15B 15/20

[52] U.S. Cl. ..... 91/275; 91/392; 91/459; 251/65

[58] Field of Search ..... 91/361, 363 R, 363 A, 91/275, 459, 385, 392; 251/65

[56] References Cited

U.S. PATENT DOCUMENTS

| | | | |
|---|---|---|---|
| 1,617,516 | 2/1927 | Farquhar | 91/275 |
| 2,286,026 | 6/1942 | Towler et al. | 91/275 |
| 2,399,833 | 5/1946 | Scofield | 121/97 |
| 3,212,406 | 10/1965 | McDuffie et al. | 91/165 |
| 3,363,514 | 1/1968 | Ramcke | 91/410 |
| 3,465,686 | 9/1969 | Nugier | 103/51 |
| 3,489,063 | 1/1970 | Piret | 91/275 |
| 3,613,892 | 10/1971 | Ziller | 210/374 |
| 3,775,028 | 11/1973 | Davis | 417/267 |
| 3,776,252 | 12/1973 | Wilcox | 137/99 |
| 3,779,401 | 12/1973 | Carroll | 214/1 BB |
| 3,847,371 | 12/1974 | Norton et al. | 251/65 |
| 3,952,619 | 4/1976 | Cook | 81/420 |
| 4,000,684 | 1/1977 | Ruffley | 91/447 |
| 4,073,311 | 2/1978 | McGeachy | 137/513.3 |
| 4,121,618 | 10/1978 | Sweeney | 91/410 X |
| 4,438,628 | 3/1984 | Creamer | 60/374 |
| 4,509,402 | 4/1985 | Salmonson | 91/275 |
| 4,545,736 | 10/1985 | Walton | 417/63 |
| 4,550,642 | 11/1985 | Langer | 91/346 |
| 4,646,531 | 3/1987 | Song | 62/187 |
| 4,742,841 | 5/1988 | Vonderhaar et al. | 137/115 |
| 4,765,225 | 8/1988 | Birchard | 91/362 |
| 4,765,385 | 8/1988 | McGeachy | 152/416 |
| 4,778,356 | 10/1988 | Hicks | 417/397 |
| 4,846,048 | 7/1989 | Hvilsted et al. | 92/5 R |
| 4,883,025 | 11/1989 | Richeson | 251/65 X |
| 4,889,035 | 12/1989 | Goodnow | 91/275 |
| 4,995,421 | 2/1991 | Bonacorsi et al. | 137/383 |
| 5,069,422 | 12/1991 | Kawamura | 251/65 X |
| 5,222,876 | 6/1993 | Budde | 417/393 |

FOREIGN PATENT DOCUMENTS

| | | | |
|---|---|---|---|
| 0070973 | 2/1983 | European Pat. Off. | 91/388 |
| 0480192 | 9/1992 | European Pat. Off. . | |
| 20883 | 2/1961 | German Democratic Rep. . | |
| 27477 | 7/1961 | German Democratic Rep. . | |
| 48-12535 | 2/1973 | Japan . | |
| 53-72972 | 6/1978 | Japan . | |
| 57-195907 | 5/1982 | Japan . | |
| 8000867 | 5/1980 | PCT Int'l Appl. . | |

*Primary Examiner*—Edward K. Look
*Assistant Examiner*—Hoang Nguyen
*Attorney, Agent, or Firm*—Raymond J. Slattery, III

[57] ABSTRACT

A fluid pressure operated piston engine assembly, such as a pump assembly, including a fluid pressure operated piston engine and a fluid valve for coupling fluid under pressure to alternative portions of the piston chamber of the piston engine. The fluid valve includes a valve spool which is translated to effect the alternative modes of coupling pressurized fluid to the piston chamber. The translation is accomplished by a shifter assembly having a shifter rod attached to the valve spool. The shifter rod includes a pair of diametrically opposed magnets attached thereto. A fork is attached to the piston engine drive shaft at one end and is mounted for limited movement along the shifter rod between the pair of magnets of the shifter rod. The interaction between the flux generated by a magnet carried by the fork with one of the magnets of the shifter rod causes the shifter rod, and in turn the valve spool, to shift from one position to another, thereby re-directing the flow of fluid to the piston chamber to effect the reversal of direction of travel of the piston and its associated drive shaft.

26 Claims, 6 Drawing Sheets

FLUID PRESSURE OPERATED PISTON ENGINE ASSEMBLY

This application is a continuation application of an U.S. application Ser. No. 07/968,447, filed Oct. 29, 1992, now abandoned.

This invention relates generally to a fluid pressure operated piston engine assembly. The invention more particularly concerns such an assembly including a fluid valve for coupling fluid under pressure to alternative portions of the piston chamber of the piston engine so that, as the drive shaft of the piston engine approaches each end of its stroke, fluid under pressure is coupled to a portion of the piston chamber to effect reversal of the direction of travel of the drive shaft. It also concerns a shifter assembly for actuating the fluid valve.

In a fluid pressure operated piston engine, a pressurized fluid is used to reciprocate a piston and an attached drive shaft to perform mechanical work. To do this, a pressurized fluid valve is generally interposed between a source of pressurized fluid and the piston chamber of the piston engine to alternatively pressurize and exhaust each end of the piston chamber. As the piston approaches an end of the chamber, and hence as the attached drive shaft approaches an end of its stroke, the valve must be actuated to effect reversal of the direction of travel of the piston and drive shaft.

Typically, in order to do this, some form of mechanical coupling is provided between the drive shaft and the pressurized fluid valve. One known form of fluid pressure operated piston engine, for example, is a pneumatically driven pump, such as may be used for pumping hot melt adhesive. One form of such a pump is described in U.S. Pat. No. 4,550,642 to Langer which also describes various other prior art systems, the disclosure of this patent describing these systems is hereby incorporated herein by reference.

One problem with the heretofore shifter assemblies is that they contain many moving parts, or require mechanical interaction (contact) between parts, or are complicated, etc. All of these, either individually or collectively, can lead to fatigue of the shifter and/or stalling of the pump assembly while also being difficult to trouble shoot.

SUMMARY OF THE INVENTION

It is an object of the present invention to provide an improved fluid pressure operated piston engine assembly which includes a pressurized fluid valve effectively cooperating with the piston engine to couple fluid under pressure to portions of the piston chamber to effect reversal of the direction of travel of the drive shaft as the drive shaft approaches each end of its stroke.

According to one aspect of the invention, it is also an object of the invention to provide a means for causing the fluid valve to shift from one position to another when the piston reaches the end of its stroke that is substantially non-contact in nature.

These and other objectives have been accomplished by providing an assembly comprising: a fluid valve having an inlet for coupling to a source of fluid under pressure, first and second discharge outlets, and a valve spool translatable between a first and second position such that in the first position the inlet is coupled to the first discharge outlet and in the second position the inlet is coupled to the second discharge outlet; and a shifter including a shifter rod coupled to the valve spool, a pair of diametrically opposed magnets carried by the shifter rod, and a means movable between said magnets for causing the shifter rod to move from either a first position relative to the valve spool to a second position, or from the second position relative to the valve rod to the first position, wherein coupling of the inlet to a discharge outlet of the fluid valve is shifted from either the first to the second outlet or from the second to the first outlet.

These objectives and others have also been accomplished by a fluid pressure operated piston engine assembly comprising: a fluid pressure operated piston engine including a piston chamber, a piston reciprocable in the chamber, and a drive shaft attached to the piston and reciprocable therewith through a drive shaft stroke having a first end and a second end; fluid valve means for coupling fluid under pressure to alternative portions of the piston chamber, including a valve spool translatable to (a) a first position in which the valve means is operable to couple fluid under pressure to a first portion of the piston chamber, tending to move the drive shaft toward the second end of its stroke and (b) a second position in which the valve means is operable to couple fluid under pressure to a second portion of the piston chamber, tending to move the drive shaft toward the first end of its stroke; first means for coupling to the fluid valve means, mounted for reciprocal movement, and including a pair of diametrically opposed magnets; and second means for coupling the first means to the piston engine drive shaft such that as the drive shaft approaches the first end of a stroke, the first means is moved to a first position relative to the valve spool and such that as the drive shaft approaches the second end of its stroke the first means is moved to a second position relative to the valve spool, wherein, as the drive shaft approaches each end of its stroke, fluid under pressure is coupled to one of the portions of the piston chamber to effect reversal of the direction of travel of the drive shaft.

Other objects and advantages of the invention, and the manner of their implementation, will become apparent upon reading the following detailed description and upon reference to the drawings.

BRIEF DESCRIPTION OF THE DRAWINGS

The following is a brief description of the drawings in which like parts may bear like reference numerals and in which.

DESCRIPTION OF THE INVENTION

Figure 1:
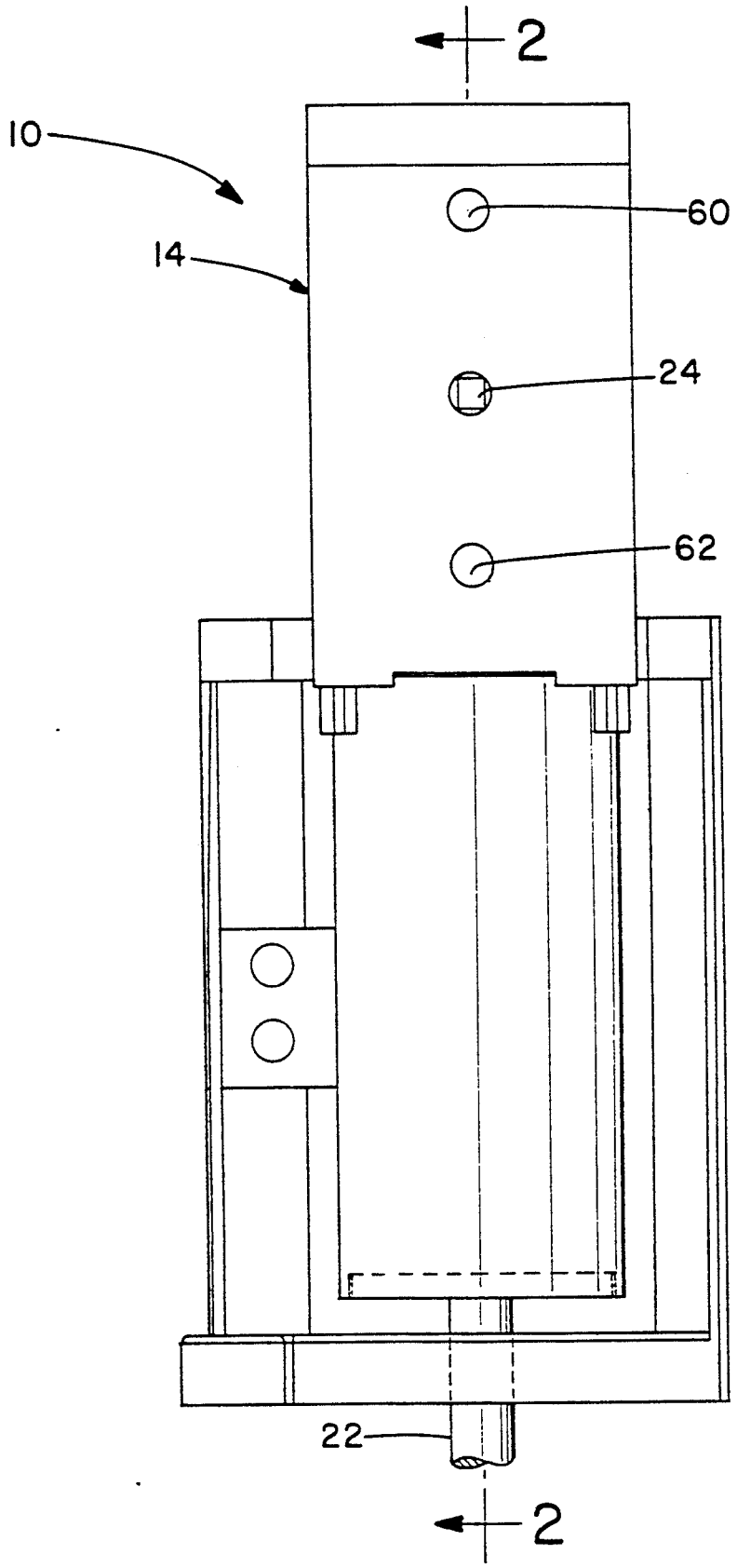
FIG. 1 is an elevational view of a fluid pressure operated piston engine assembly in accordance with one embodiment of the invention.

With reference now to the figures, a fluid pressure operated piston engine assembly, shown generally as reference numeral 10, includes a fluid pressure operated piston engine 12 and a fluid valve 14 for coupling fluid under pressure to the piston engine. The piston engine 12 includes a housing 16 defining a piston chamber 18 in which a piston 20 reciprocates. Attached to, and reciprocable with, the piston 20 is a drive shaft 22. The drive shaft 22 may serve as a pump shaft, for example, if the piston engine 12 is employed as a pump. When employed as a pump, this assembly is especially suited for pumping adhesives, such as for example, hot melt adhesive.

The pressurized fluid valve 14, in the illustrated form, is a pneumatic valve for selectively coupling pressurized air from a pressurized air source (not shown) through an air inlet 24 to the piston chamber 18. A valve spool 26, which serves as a flow-directing valve element, is translatable within a sleeve 28, having a multi-stepped bore mounted within a housing 30 of the fluid valve 14.

In the illustrated form, pressurized air communicates through the inlet 24 into an annulus 32 forming a portion of the bore of the sleeve 28. The pressurized air communicates from the annulus 32 to either annulus 34 or 36 of the bore via reduced diameter portions 38, 40, respectively, of the bore, depending upon the position of the valve spool 26. The outer diameter of the valve spool 26 varies to form stepped portions for directing the flow of pressurized air.

Figure 2:
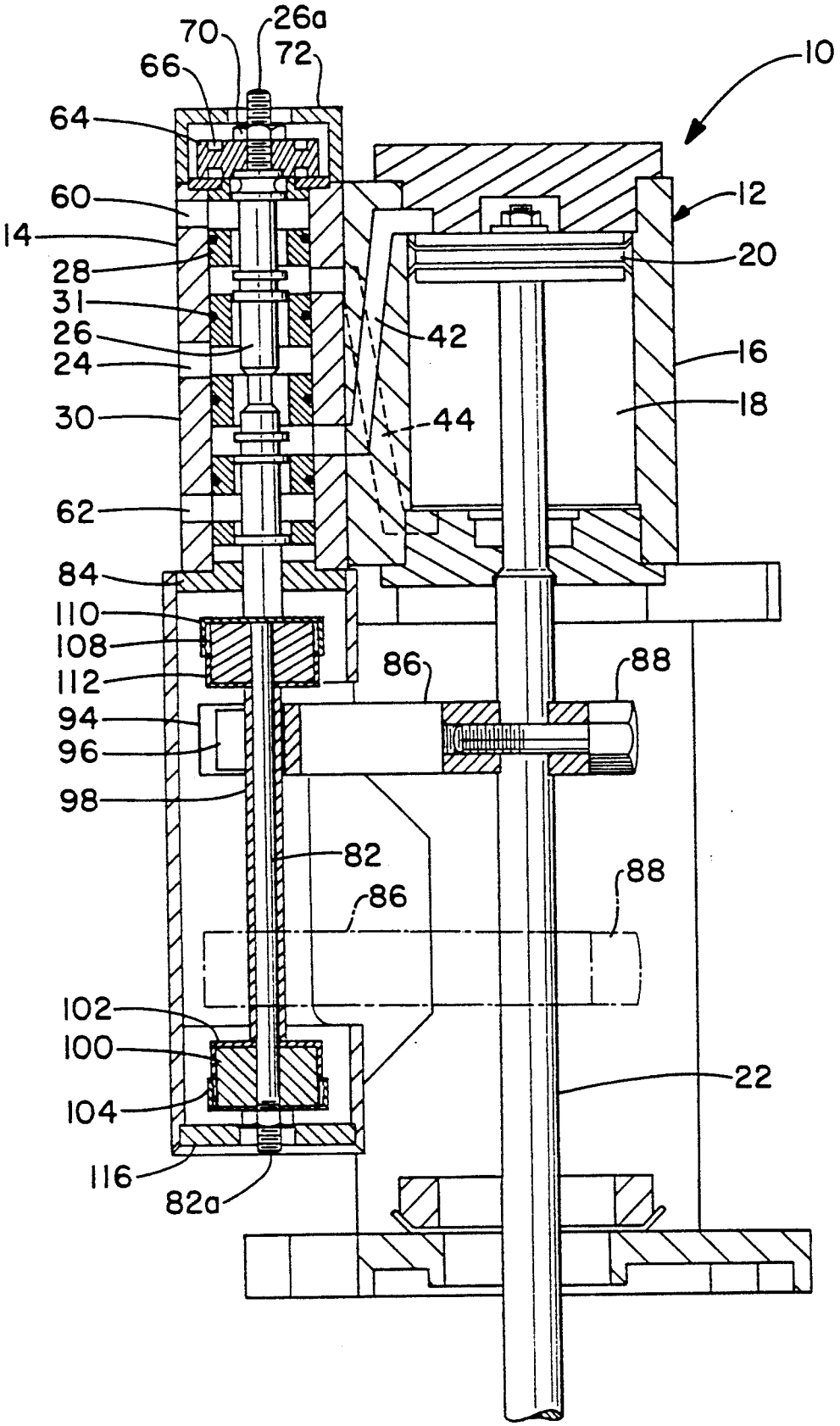
FIG. 2 is an elevational view in cross-section, of the assembly of FIG. 1 taken substantially along line 2—2 and showing the assembly in a first position.
Figure 3:
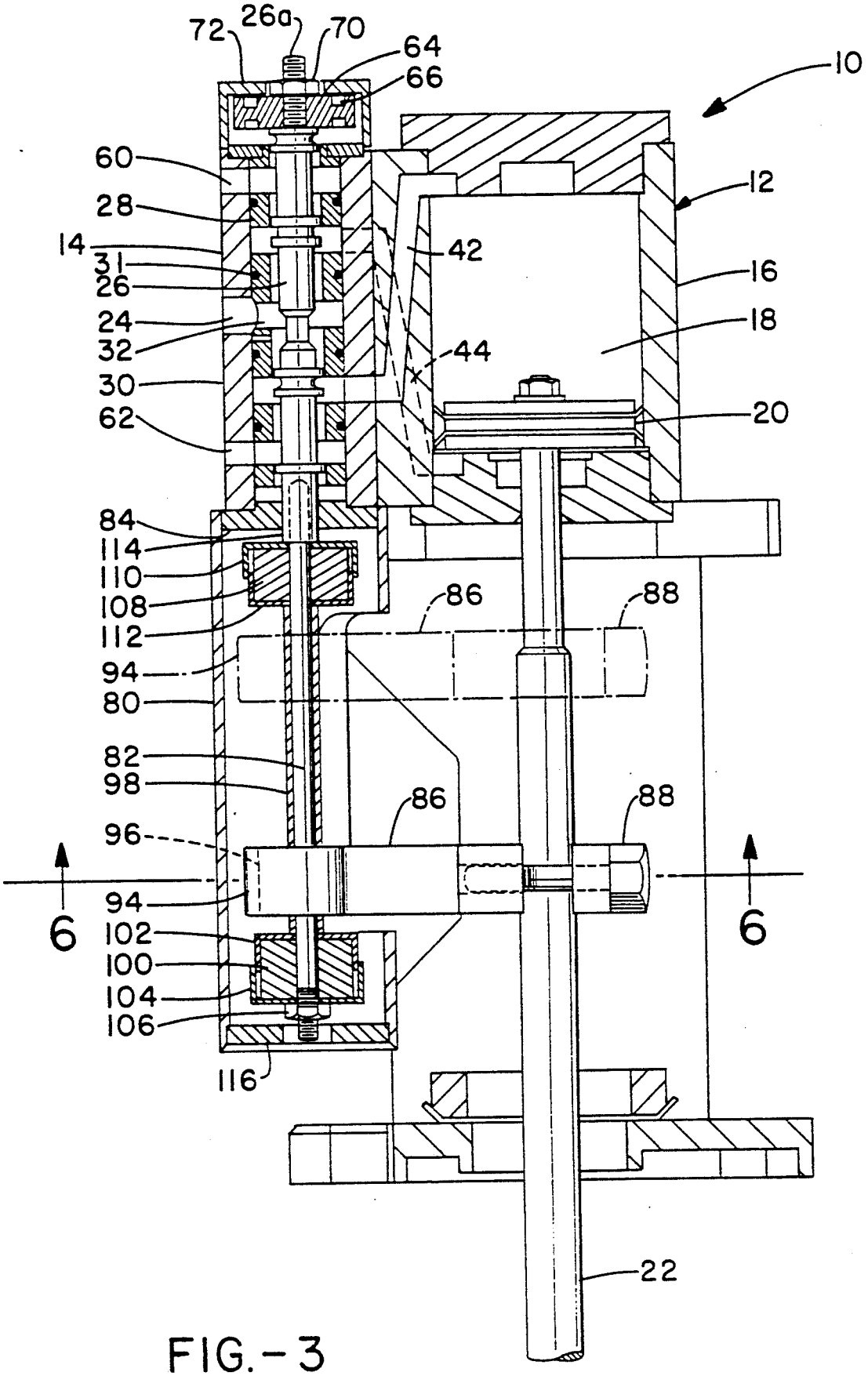
FIG. 3 is the elevational view similar to that of FIG. 2, but showing the assembly in its second position.
Figure 4:
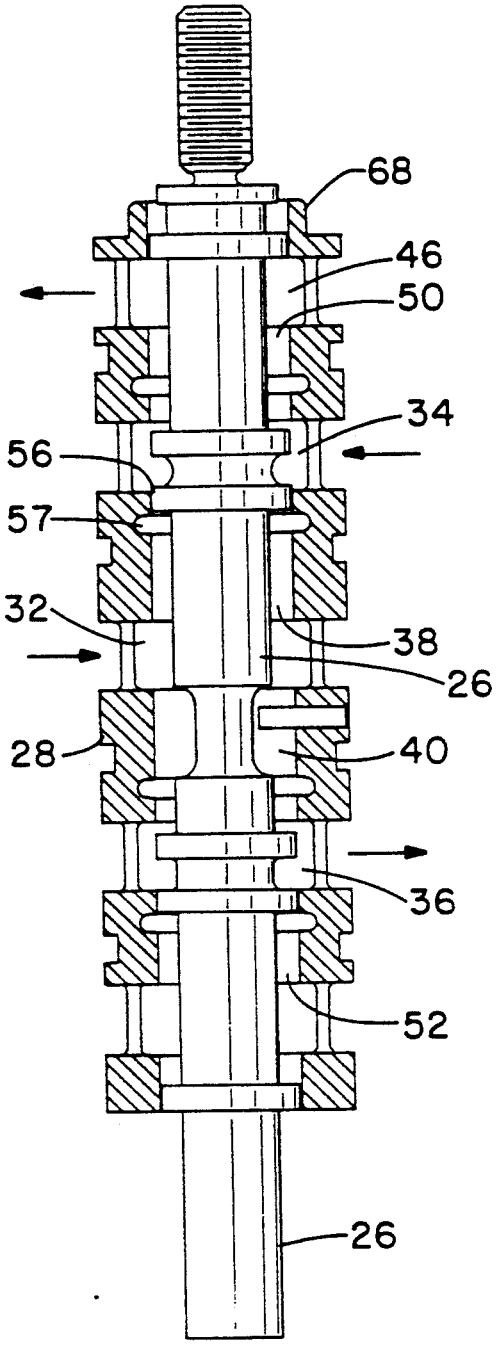
FIG. 4 is an enlarged cross-sectional view of the valve spool and sleeve of the fluid valve corresponding to the position shown in FIG. 2.
Figure 5:
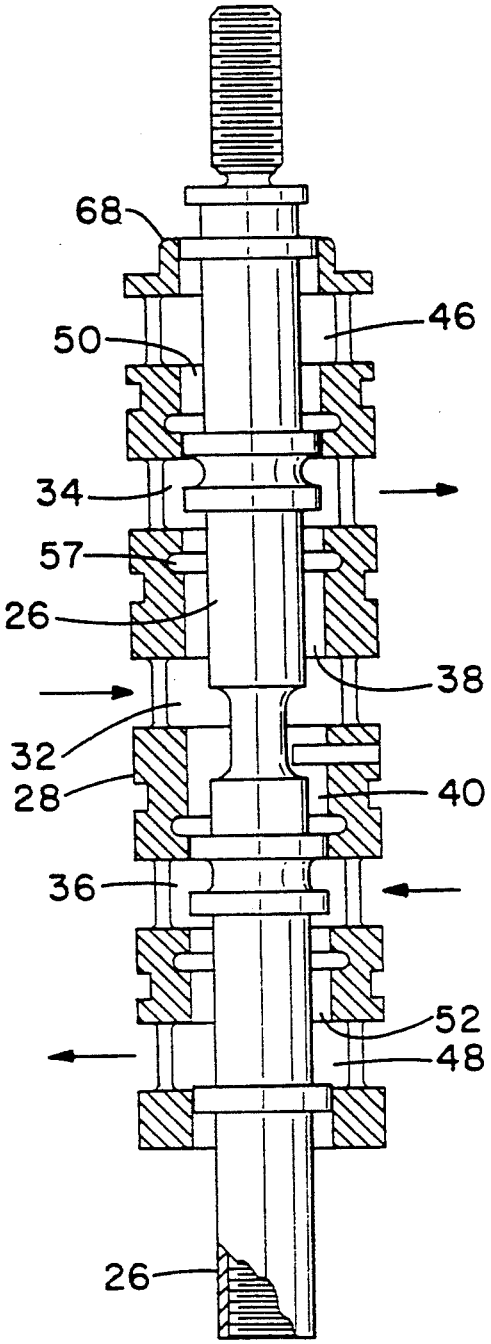
FIG. 5 is an enlarged cross-sectional view of the valve spool and sleeve corresponding to that shown in FIG. 3.

With the valve spool 26 positioned as shown in FIGS. 2 and 4, the pressurized air is coupled from the air inlet 24, through the annulus 32, portion 40, and annulus 36 of the bore of the sleeve, and through a passageway 42 to the top of the piston chamber 18. When the spool 26 is in the position shown in FIGS. 3 and 5, the pressurized air is coupled from the air inlet 24, through the annulus 32, portion 38, and annulus 34 of the bore, and through a passageway 44 communicating with the bottom of the piston chamber 18. Passageways 42 and 44 are shown in a diagonal or crossing pattern for clarity, however, they could both extend substantially in the vertical direction with respect to FIG. 2.

An exhaust annulus 46 of the bore of the sleeve 28 is couple to the annulus 34 via a reduced diameter portion 50. In like manner, as exhaust annulus 48 of the bore is coupled to the annulus 36 via a reduced diameter portion 52. As before, the flow of air between each pair of annuluses 34, 46; 36, 48 is dependent upon the position of the valve spool 26. Each exhaust annulus is coupled to an opening in the housing 30 of the fluid valve so that air may be vented from the piston chamber as the piston moves from one end of the chamber to the other.

In order to reciprocate the piston 20 and the drive shaft 22, and, for reference, referring initially to the positions of the valve spool 26 and piston 20 shown in FIG. 2, the pressurized air is coupled through the inlet 24 and the annulus 32. The air passes through the reduce diameter portion 40 to annulus 36, but is prevented from passing to annulus 34 by a larger diameter portion 56 of the valve spool 26. From annulus 36 the air passes through the passageway 42 to the upper portion of the piston chamber 18. The pressurized air acts upon the upper face of the piston 20, forcing the piston and the drive shaft 22 downwardly. As the piston 20 moves downwardly, the air in the lower portion of the chamber 18 is exhausted through the passageway 44 to the annulus 34, through the reduced diameter portion 50, annulus 46, and then the exhaust opening 60 in the top of the valve housing 30 were upon the air is vented out of the assembly.

In a manner to be described further below, when the piston 20 nears the bottom of the chamber 18, the valve spool 26 is slideably moved within the sleeve. With reference to FIGS. 2 and 4, the valve spool 26 will be moved upwardly to the position shown in FIGS. 3 and 5. This causes the various different portions of the stepped outer diameter of the valve spool 26 to align differently with the stepped bore of the sleeve 28, thereby causing the air flow path to be redirected along a different flow path. Pressurized air is then coupled through the fluid valve 14 so that the pressurized air is coupled to the passageway 44 to act upon the lower face of the piston 20. The thus-applied force on the lower face of the piston 20 drives the piston back to the top of the chamber 18, whereupon the fluid valve 14 is again slideably moved to its previous position of FIGS. 2 and 4. The cycle is then repeated. During the time that the piston 20 moves upwardly through the chamber 18, the air in the upper portion of the chamber is exhausted through the passageway 42, annulus 36, portion 52, annulus 48 and finally out of the opening 62 in the bottom of the valve housing 30.

Attached to the upper end of the valve spool 26 is a stop plate 64 having a pair of rings 66. The stop plate 64 is held by the upper shoulder 68 of the spool valve and by a nut 70 threadably attached to the upper end of the spool valve 26. The stop plate 64 provides a detent for limiting the travel of the spool valve 26 as it slideably moves within the bore of the sleeve 28. With reference to FIG. 3, the stop plate 64 limits the upward travel of the spool by interacting with the cap portion 72 of the housing 30 of the fluid valve. The rings 66 are somewhat resilient so that they act similar to a shock absorber. The rings may be, for example, comprised of an elastomer, Tetrafluoroethylene, or other material.

To insure that the air valve is resistant to the formation of deposits within the air valve, it is preferred that the outer stepped portion of the spool, such as the larger diameter portion 56, wipes across the bore, of the housing, such as reduced diameter portion 38. Deposits will then be wiped into the larger portions, such as 34 of the bore or various pockets 57.

Normal valve design tolerances for a half inch diameter spool (as measured at the larger diameter portions, such as 56) are ±0.0001 inches. However, for pump assemblies for use in hot melt dispensing systems, it has been found that spools and sleeves manufactured to this tolerance had a tendency to gum up and stick, while those manufactured to ±0.001 inches tended to leak. Therefore, the preferred tolerance lies somewhere there between. Good results have been obtained however, for spools and sleeves manufactured of a hardened stainless steel and having a ±0.0005 tolerance. This is a larger clearance than is found with typical air valves. It has also been found for this particular combination that it is preferred that the air utilized by the air valve is non-lubricated air.

In order to activate the fluid valve 14 as the piston 20 approaches the top or bottom of the piston chamber 18, and consequently as the drive shaft 22 approaches the ends of its stroke, the motion of the drive shaft is transmitted to the valve spool 26 via a shifter assembly 80. The shifter assembly 80 includes a shifter rod 82 which is threadably attached to the valve spool 26. The shifter rod 82 extends from the fluid valve 14 and through an opening in the end cap 84 of the shifter assembly 80. The shifter rod 80 is substantially parallel to the drive shaft 22 of the piston engine. The shifter assembly 80 further includes a fork 86, attached to the piston drive shaft 22 and is mounted for limited translation upon the shifter rod 82. For example, a screw 88 extends from an end 90 of the fork to a mid portion 92 of the fork, between these two positions, the fork forms substantially a "C" about the piston drive shaft 22. As the screw 88 mates with the portion 92 of the fork, the "C" of the fork is tightened to grip the drive shaft 22.

Figure 6:
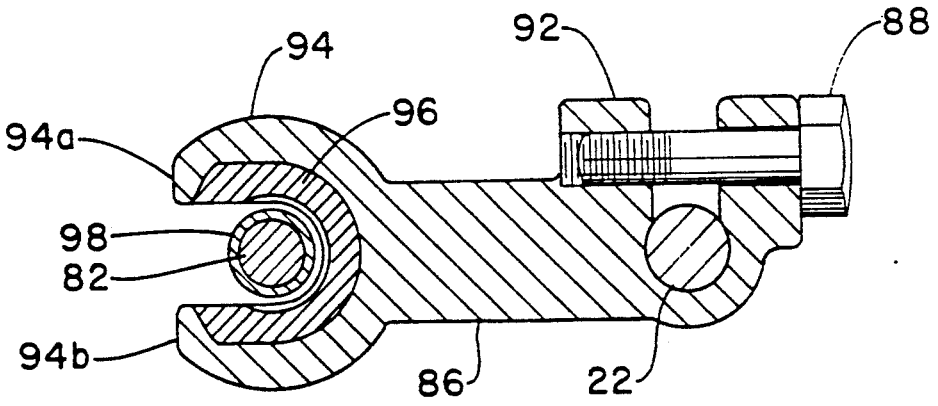
FIG. 6 is a cross-sectional view of the fork, taken substantially along line 6—6.

The forked end 94 of the fork 86 carries a magnet 96 which is located in a milled pocket of the fork 86. The magnet 96 is substantially "C" shaped as viewed in FIG. 6, wherein the shifter rod 82 and a sleeve 98 are disposed between the tines of the "C". It is preferred that the shifter rod 82 and the sleeve 98 are able to freely slide there through as the valve spool 26 moves in reciprocal motion and allows for the fork 86 to move along the sleeve 98 of the shifter rod 82 in conjunction with the reciprocal motion of the drive shaft 22. It is therefore preferred that the sleeve 98 is spaced apart from the tines of the fork and magnet 96 so that the fork and the magnet straddle, but do not contact the sleeve 98. It is not recommended that the magnet 96 be allowed to make slidable contact with the sleeve 98. Therefore, it is preferred that the spacing between the tines 94*a*, 94*b* of the fork is less than the spacing between the tines of the magnet. In other words, the magnet is spaced further from the sleeve 98 than the fork, so that if the fork comes in contact with the sleeve 98, the magnet will not, thereby preventing wear and/or damage to the magnet.

At the end of the shifter rod 82, farthest from fluid valve 14, is another magnet 100. This magnet is similar to the magnet 96, but instead of being "C" shaped, it is substantially ring like or circular. The magnet 100 is sandwiched between a pair of caps 102, 104 which help prevent physical damage to the magnets. The magnet 100 is secured to the shifter rod by a nut 106 at one end and the interaction of the cap 102 and the sleeve 98 at the other end.

Between the end cap 84 and the fork 86 is a third magnet 108 which is similar to the magnet 100. Again, the magnet 108 is sandwiched between two caps 110, 112 and are secured to the shifter rod 82 by a shoulder 114 of the shift rod 82 at one end and the sleeve 98 of the shifter rod at the other.

The magnets 96, 100, 108 are permanent magnets. If fluid pressure piston engine assembly is to be used to pump hot melt adhesives, it is preferred that the permanent magnets be of a samarian cobalt, $SM_2CO_{17}$, magnet construction. This is because it is well known that heat can affect the magnetic strength of a permanent magnet. Therefore, the choice of a permanent magnet for the pumping of hot melt adhesives must be able to withstand the temperatures commonly experienced in the heating and melting of such hot melt adhesives. For example, in a hot melt adhesive system, it could be expected that the shifter could be exposed to temperatures from about 200° F. (93.3° C.) to about 350° F. (177° C.). Samarian cobalt magnets, typically operate well at temperatures below 450° F. (232° C.). Therefore, if this embodiment is to be used in the dispensing of hot melt adhesives, then it is believed that samarian cobalt magnets are preferred.

Each permanent magnet produces its own associated field of flux. The interaction of these fields is important to the effectiveness of the shifting. In order to provide smooth shifting in either direction, it is preferred that the shifter magnets 100, 108 are substantially the same size and configuration. In like manner, the fork magnet 96 is similar to the shifter magnets 100, 108. The forked magnet 96 could be circular with the shifter rod 82 and sleeve 96 passing through its center. Such a configuration is more difficult to assemble and disassemble. However, by providing a slot in a circular configuration, the fork magnet retains substantially the same circular configuration while allowing the shifter rod 82 and sleeve 96 to be easily disengaged from the fork, thereby facilitating assembly and disassembly.

In that ferro-magnetic materials can affect the field (either focusing or distorting it) of a magnet, shifter rod 82, its associated sleeve 98, and the fork 86 should be of a non-magnetic material. For example, a passivated stainless steel may be used, such as 300 series stainless steel, or other non-magnetic materials such as aluminum, brass, etc. Similarly, it is believed that it is preferred that the magnet caps 102, 104, 110, and 112 associated with each respective magnet be also of a non-ferro-magnetic material.

Due to the presence of the magnetic fields, it is preferred that the valve spool 26 and the sleeve 28 of the fluid valve are also manufactured from a non-magnetic material or of a material which is only somewhat magnetic, such as a hardened stainless steel. For example, valve spools and sleeves of stainless steel having a 45–55 Rockwell "C" rating work well for hot melt applications. This prevents the possibility that one or both of these parts could become magnetized, thereby preventing or hindering the sliding movement of the valve spool 26 within the sleeve 28, and thus interfering with the direction of the flow of air to and from the piston chamber 18. In such embodiment, the housing 30 was aluminum and there were a plurality of o-rings 31 to accommodate the expansion and contraction of the two dissimilar metals.

On the other hand, certain elements of the assembly should be of a ferro-magnetic material, so as to aid in the directing of the magnetic field so that it can be more effectively utilized and/or contained. As such, it is preferred that the end caps 84, 116 of the shifter assembly be of a ferromagnetic material. This also provides a detent mechanism which will be more fully described below.

The polarity of the magnets are arranged such that as the fork magnet 96 is moved toward either of the shifter rod magnets 100, 108, there will be an attraction therebetween. For example, if the shifter rod magnets 100, 108 are installed such that a north pole is located in conjunction with the upper caps 102, 110, respectively, then the fork magnet 96 will have its north pole located towards the upper shifter rod magnet 108. Shifting of the fluid valve 14 is accomplished by bringing the magnet 96 of the fork 86 within close proximity to one of the spool magnets. At some point the attraction between the magnet 96 of the fork 86 and the spool magnet will be great enough to cause the spool magnet, along with the shifter rod 82, and a valve spool 26 to move towards the magnet 96 of the fork. This sliding movement will cause the elements of the valve spool 26 to realign themselves causing the piston to move in the opposite direction.

For example, with reference to FIG. 2, as the drive shaft 22 and the piston 20 approach the end of its stroke, the fork 86 will be moved towards the shifter rod magnet 100. As the force of attraction between fork magnet 96 and the shifter rod magnet 100 increases, it will eventually be great enough to pull the shifter rod magnet 100 towards the magnet 96 of the fork 86. This in turn cause shifter rod 82 and the valve spool 26 to be moved in the same direction, such as is illustrated in FIG. 3. Once shifted, the fluid valve 14 redirects the air flow as described above such that the direction of motion of the drive shaft 22 and its associated piston 20 is reversed. This in turn moves the fork 86 towards the other shifter rod magnet 100. Again, as the drive shaft and piston approach the end of a stroke, the attraction between the magnet 96 of the fork and the magnet 108 of the shifter rod 82 will cause the magnet 108 to move towards the fork 86. This in turn causes the fluid valve 14 to shift, thereby reversing the flow of air and returning the assembly to that as illustrated in FIG. 2. By properly positioning and sizing the various magnets, the shifting of fluid valve 14 may be accomplished as a non-contact operation. In other words, the magnets of the shifter rod may become adjacent to, but do not contact the magnet of the fork. A non-contact operation should have improved wear characteristics, and, therefore, improved durability over previous designs. Furthermore, by keeping the magnets spaced a predetermined distance apart, the force required to separate the magnets will be less than if they were in a contact position. Also, in that the force exerted on or between the respective magnets increases as the magnets are brought closer and closer together during the stroke of the piston and the drive shaft, there is less likelihood that the fluid valve will be prevented from shifting, which in turn produces a less likelihood that the pump will stall.

In prior art air valves, it is common for various contaminants, such as varnish like substances, to accumulate within the air valve so that more and more force is required to shift the air valve completely from one position to the other. Some shifter assemblies exert the greatest amount of force at the beginning of the shift and taper off to a lesser force as the shifting process is completed. For example, a shifter utilizing a spring will work in this manner because the spring's force is typically the greatest at the beginning of the shift. In such shifters, there may be enough force to overcome the contaminants and cause the valve to begin to shift. However, as the force of the shifter diminishes as the air valve moves, it is possible that the force will diminish to a point were it will not be able to overcome the resistive force caused by the contaminants. This results in the air spool failing to completely move from one position to the other. This, in turn, causes the pump to stall.

With reference to FIG. 2, the shifting force exerted by the shifter on the air valve increases as the shifter moves from one position to another. For example, as the magnet 96 carried by the force 86 moves from its lower position (as oriented with reference to FIG. 2) near magnet 100, the force of attraction continuously increases between it and the upper magnet 108. At some point, the force of attraction between the magnets 108 and 96 will become so great that the spool, shifter rod, and the magnet 108 will begin to move downward. Once they begin to move downward, they should continue to shift because the force drawing them downward continuously increases until the air valve has completely shifted downward and the fork has reached its most upward portion of the stroke. Therefore, once the air valve begins to move, there is a much greater probability that the shift will be completed because the force of attraction is increasing, thereby being less sensitive to the build-up of contaminants.

The interaction between the magnets 100, 108 of the shifter rod 82 with the respective end cap 84, 116 provide a detent in order to prevent the shifter and the fluid valve from moving from one position to another as the fork moves between the shifter rod magnets. Therefore, whichever shifter rod magnet is located closest to its respective end cap, the force of attraction therebetween should be strong enough to prevent inadvertent movements of the shifter and the fluid valve, but not strong enough to prevent the shifter rod magnet from moving towards the magnet of the fork at the time of shifting.

Alternatively, the "C" magnet may be replaced with two parallel bar magnets. The shifter rod would pass between the spaced apart magnets similar to the slot in the "C" magnet of the fork. In this alternate embodiment, the length of the bar magnets must have a longer dimension than the outer diameter of the shifter rod magnets. This embodiment provides a means for reducing or eliminating side loading which may be associated with the shifter rod. With ring magnets and "C" magnets, side loading of the shifter rod may occur due to misalignment between the shifter rod magnet and the fork magnet. This misalignment can result from tolerance differences which cause the physical parts to be misaligned, or from differences wherein the magnetic center of the magnet varies from its geometric center. If there is a misalignment between the "C" shaped magnet and a ring magnet, then they will tend to resist any force that tries to move them out of, or hold them out of, their true magnetic alignment. For example, if the fork magnet and the shifter rod magnets are held out of magnetic alignment by their connections to the pump piston and the air valve respectively, they will exert a force on these components, in the form of a side load, which in turn can cause increased friction and wear to these components. Providing a means for allowing the fork magnet and magnet shaft magnets to move into magnetic alignment will eliminate this problem. The slot formed by the bar magnets provides an adjustment which allows the ring magnet of the shifter rod to compensate for any misalignment between it and the magnet 96 of the fork.

Figure 7:
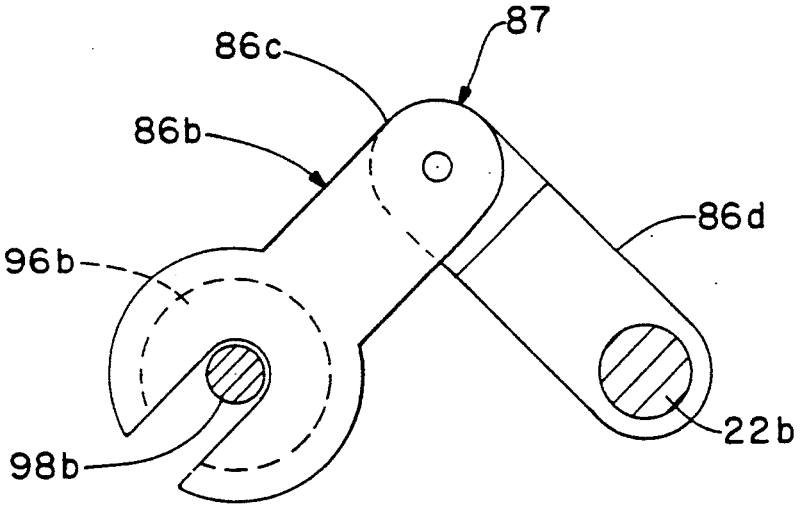
FIG. 7 is a plane view of an alternate fork for the assembly of FIGS. 1, 2, and 3.

Alternately, with reference to FIG. 7, the one piece fork may be replaced with a two piece fork **86*b*, in which members 86*c* and 86*d* are connected together by a hinge 87. The connection of the fork 86*b* to the drive shaft 22*b* is changed to allow it to pivot about the shifter rod. This allows the "C" shaped fork magnet 96*b*** the freedom to swing in an arc about the shifter rod and position itself within the shifter rod so that it can magnetically align itself with the shifter rod magnet and thus eliminate or reduce side loading.

Also, since the fork magnet has less cross-sectional area due to the hole and slot for the shifter rod, its magnetic center is not necessarily the circular center of the magnet. Therefore, it is believed to be preferable to position the shifter rod at the magnet's centroid.

Spacing the fork and its associated magnet from the sleeve 98 and shifter rod 82 provides as an aid in trouble shooting the system. For example, if the pump was to stall, the air valve may be manually activated by pushing on either the end 26a of the spool 26 or the end 82a of the shifter rod 82. If the air valve moves freely, then the stall was probably not the result of the air valve. In other prior art shifters, it is necessary to first physically disconnect the shifter from the pump drive shaft, which can be difficult and time consuming.

Figure 8:
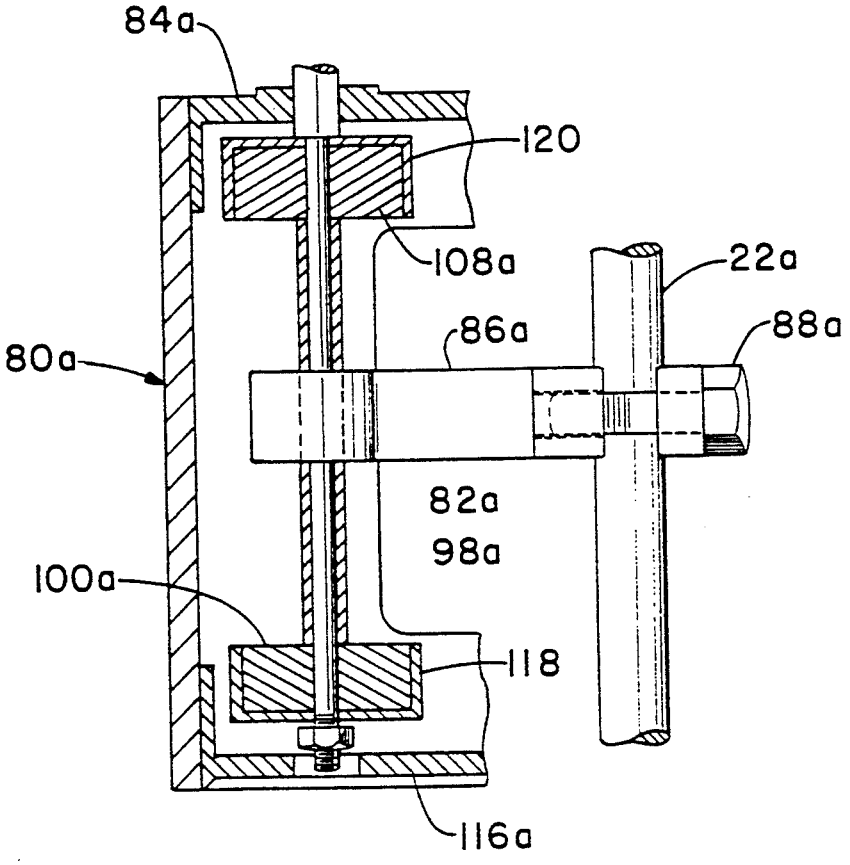
FIG. 8 is a partial elevational view of an alternate shifter assembly for use with a fluid pressure operated piston engine.

While the invention has been described with reference to a preferred embodiment, it should be understood by those skilled in the art that various changes may be made and equivalents may be substituted for elements thereof without departing from the scope of the invention. For example, with reference to FIG. 8, there is illustrated a cross-sectional view of an alternate shifter assembly 80a. In this arrangement, the fork 86a is of a ferromagnetic material and does not contain a fork magnet. The fork 86a is attached to the drive shaft 22a of the piston as before. The shifter rod magnets 100a, 108a are mounted in steel cups 118, 120 respectively to contain the lines of flux and increase the force of attraction between the shifter rod magnets and the ferro-magnetic fork 86a. As before, as the drive shaft 22a of the piston reaches the end of a stroke, the fork 86a approaches one of the shifter rod magnets. As the gap between the fork 86a and a shifter rod magnet decreases, the force of attraction will increase. This force of attraction will increase until the shifter rod magnet is pulled toward the fork 86a. Thus shifting the fluid valve 14 to cause the air directed in the piston chamber to be reversed, thereby reversing the direction of the piston and the drive shaft 22a.

It is claimed:

1. A fluid pressure operated piston engine assembly comprising:

a fluid pressure operated piston engine including a piston chamber, a piston reciprocable in the chamber, and a drive shaft attached to the piston and reciprocable therewith through a drive shaft stroke having a first end and a second end;

fluid valve means for coupling fluid under pressure to alternative portions of the piston chamber, including a valve spool translatable to (a) a first position in which the valve means is operable to couple fluid under pressure to a first portion of the piston chamber, tending to move the drive shaft toward the second end of its stroke and (b) a second position in which the valve means is operable to couple fluid under pressure to a second portion of the piston chamber, tending to move the drive shaft toward the first end of its stroke;

first means for coupling to the fluid valve means, mounted externally from the piston chamber, for reciprocal movement, and including a pair of diametrically opposed magnets; and second means for mechanically coupling the first means to the piston engine drive shaft such that as the drive shaft approaches the first end of a stroke, the first means is moved to a first position relative to the valve spool and such that as the drive shaft approaches the second end of its stroke the first means is moved to its second position relative to the valve spool, wherein, as the drive shaft approaches each end of its stroke, fluid under pressure is coupled to one of said portions of the piston chamber to effect reversal of the direction of travel of the drive shaft.

2. The apparatus of claim 1 wherein as the piston engine drive shaft is moved to the end of a stroke, the second means is moved toward one of the magnets of the first means until the force of attraction becomes so great therebetween that the first means is caused to move from either the first position to the second position or from the second position to the first position.

3. The apparatus of claim 1 wherein the second means includes a ferro-magnetic portion, disposed between the pair of magnets.

4. The apparatus of claim 1 wherein the second means includes a magnet disposed between the pair of magnets of the first means.

5. The apparatus of claim 1 further comprising a detent means for retaining the first means in either the first or second position until the piston engine drive shaft reaches an end of a stroke.

6. The apparatus of claim 2 further comprising a detent means for retaining the first means in either the first or second position until the piston engine drive shaft reaches an end of a stroke.

7. The apparatus of claim 4 wherein said magnets are comprised of samarian cobalt.

8. The apparatus of claim 1 wherein the fluid valve means is capable of being manually operated, independent of the piston engine, without decoupling the second means.

9. The apparatus of claim 4 further comprising a means for compensating for magnetic misalignments between at least one of said magnets carried by said first means and the magnet of said second means.

10. The apparatus of claim 4 wherein the magnet of said second means includes a pair of parallel bar magnets.

11. The apparatus of claim 4 wherein the magnet of said second means is substantially "C" shaped in cross section.

12. An assembly comprising:

a fluid valve having an inlet for coupling to a source of fluid under pressure, first and second discharge outlets, and a valve spool translatable between a first and second position such that in the first position the inlet is coupled to the first discharge outlet and in the second position the inlet is coupled to the second discharge outlet; and a shifter including a shifter rod coupled to the valve spool, a pair of diametrically opposed magnets carried by the shifter rod, and a means movable between said magnets and adapted for coupling to a shaft of a piston engine, for causing the shifter rod to move from either a first position relative to the valve spool to a second position or from the second position relative to the valve spool to the first position, wherein coupling of the inlet to a discharge outlet of the fluid valve is shifted from either the first to the second outlet or from the second to the first outlet.

13. The apparatus of claim 12 wherein the means includes a ferro-magnetic portion disposed between the pair of magnets.

14. The apparatus of claim 12 wherein the means includes a magnet disposed between the pair of magnets of the shifter rod.

15. The apparatus of claim 14 further comprising a means for compensating for magnetic misalignments between at least one of said magnets carried by the shifter rod and said magnet disposed between the pair of magnets of the shifter rod.

16. The apparatus of claim 15 wherein said means for compensating is a hinge means.

17. The apparatus of claim 12 further comprising a detent means for retaining the shifter rod in either the first or second position until the means causes the shifter rod to change positions.

18. The apparatus of claim 12 further comprising:

a fluid pressure operated piston engine including a piston chamber, a piston reciprocable in the chamber, a drive shaft attached to the piston and reciprocable therewith through a drive shaft stroke having a first and a second end, a means for coupling the first and second discharge outlets of the fluid valve to a first and second portion of the piston chamber, respectively, of its stroke; and wherein said means of the shifter is coupled to the piston engine drive shaft such that as the drive shaft approaches each end of its stroke, fluid is coupled to a portion of the piston chamber to effect reversal of the direction of travel of the drive shaft.

19. The apparatus of claim 18 wherein the means of the shifter comprises:

a bar means attached at a first end to the piston drive shaft and mounted for slidable movement with respect to the shifter rod at a second end;

a magnet carried by the second end of the bar means for movement between the shifter rod magnets such that as the piston engine drive shaft reaches the end of a stroke, the force of attraction between the magnet of the bar means and that of one of the magnets of the shifter rod causes the shifter rod to shift from one position to another, which in turn causes the air valve to move from one position to another wherein the air flow to the piston chamber causes a reversal of the direction of travel of the drive shaft.

20. The apparatus of claim 19 wherein each magnet of the shifter rod has a first pole face oriented toward the magnet carried by the bar means and a second pole face distal therefrom; and wherein the detent means includes a ferro-magnet plate spaced from the second pole face of each of the magnets of the shifter rod.

21. The apparatus of claim 20 wherein said bar means is substantially a fork having tines; wherein the magnet of the bar means is substantially a "C" in cross-section; and wherein the opening of the magnet and tines of the fork straddle the shifter rod.

22. The apparatus of claim 21 wherein said fork further comprises first and second portions hingably connected together.

23. The apparatus of claim 19 wherein said magnets are comprised of samarian cobalt.

24. An assembly for pumping heated adhesives comprising:

a pump including a piston chamber, a piston reciprocable in the chamber, and a pump shaft attached to the piston and reciprocable therewith through a pump shaft stroke having a first end and a second end;

an air valve mounted externally from the piston chamber, capable of operating at temperatures of at least 350°, for coupling air under pressure to alternative portions of the piston chamber, including a valve spool disposed within a valve sleeve and mounted for translatable movement between a first position in which the air valve is operable to couple air under pressure to a first portion of the piston chamber, tending to move the pump shaft toward the second end of its stroke and a second position in which the air valve is operable to couple air under pressure to a second portion of the piston chamber, tending to move the pump shaft toward the first end of its stroke, the valve spool having a stepped outer surface having a plurality of larger diameter portions, the larger diameter portions having a ½ inch diameter and a tolerance of about 0.0005 inches; and a shifter mounted externally from the piston chamber, capable of operating at temperatures of at least 350°, including a shifter rod attached to the valve spool, a pair of diametrically opposed magnets, comprising samarian cobalt, carried by the shifter rod, and a means moveable between said magnets, but spaced from said shifter rod and coupled to the pump shaft, for causing the shifter rod to move between first and second positions such that the movement of the shifter rod to the first position causes the valve spool to move to the valve spool first position, while the movement of the shifter rod to the second position causes the valve spool to move to the valve spool second position, wherein, as the pump shaft approaches each end of its stroke, fluid under pressure is coupled to one of said portions of the piston chamber to effect reversal of the direction of travel of the pump shaft.

25. The assembly of claim 18 wherein the valve spool and the valve sleeve comprise hardened stainless steel and said valve sleeve being disposed within a housing of aluminum and having a means for accommodating the expansion and contraction between the housing and the sleeve.

26. The assembly of claim 19 wherein said means is substantially a fork having a pair of tines at one end spaced from the shifter rod a predetermined distance and attached at another end to the pump shaft; said fork carrying a magnet which straddles the shifter rod;

wherein as the pump shaft reaches the end of a stroke, the force of attraction between the magnet of the fork and that of one of the magnets of the shifter spool causes the shifter spool to shift from one position to another, which in turn causes the air valve to move from one position to another such that the air flow to the piston chamber causes a reversal of the direction of travel of the drive shaft.

* * * * *